US008186182B2

(12) United States Patent
Nolan

(10) Patent No.: US 8,186,182 B2
(45) Date of Patent: May 29, 2012

(54) SURGE FILL APPARATUS AND METHOD FOR TOP LOAD WASHING MACHINE

(75) Inventor: Kevin Farrelly Nolan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/945,002

(22) Filed: Nov. 12, 2010

(65) Prior Publication Data

US 2012/0090360 A1 Apr. 19, 2012

(51) Int. Cl.
*D06F 33/00* (2006.01)
*D06F 37/00* (2006.01)

(52) U.S. Cl. ..... 68/12.19; 68/207

(58) Field of Classification Search ..... 68/12.05, 68/12.19, 53, 58, 62, 147, 207
See application file for complete search history.

(56) References Cited

U.S. PATENT DOCUMENTS

| | | | | |
|---|---|---|---|---|
| 2,287,927 | A * | 6/1942 | Altorfer | 68/23.5 |
| 2,588,774 | A * | 3/1952 | Smith | 68/12.13 |
| 5,241,843 | A * | 9/1993 | Hein | 68/3 R |
| 5,899,097 | A * | 5/1999 | Adler | 68/18 R |
| 7,000,437 | B2 * | 2/2006 | Raney et al. | 68/18 F |
| 7,076,814 | B2 | 7/2006 | Ostrowski et al. | |
| 2007/0130698 | A1 * | 6/2007 | Kim | 8/158 |

* cited by examiner

*Primary Examiner* — Joseph L Perrin
(74) *Attorney, Agent, or Firm* — Dority & Manning, P.A.

(57) ABSTRACT

A surge fill apparatus and method for a top load washing machine is disclosed. A top load washing machine includes a cabinet, a tub positioned within the cabinet, and a basket for receiving a wash load rotatably supported within the tub. The washing machine further includes a reservoir in fluid communication with the tub. The reservoir has the capacity to store a volume of wash fluid. The reservoir releases the volume of wash fluid into basket when the volume of wash fluid in the reservoir reaches a threshold level. In this manner, the apparatus and method of the present disclosure provides for a surge of wash fluid to be provided to the top portion of a wash load such that the top portion of the wash load can be cleaned and rinsed more efficiently.

8 Claims, 4 Drawing Sheets

SURGE FILL APPARATUS AND METHOD FOR TOP LOAD WASHING MACHINE

FIELD OF THE INVENTION

The present disclosure relates generally to washing machines, and more particularly to a surge fill apparatus and method for top load washing machines.

BACKGROUND OF THE INVENTION

Washing machines typically include a cabinet which receives a stationary tub for containing wash and rinse water. A wash basket is rotatably mounted within the wash tub, and an agitating element is rotatably positioned within the wash basket. A drive assembly and a brake assembly can be positioned with respect to the wash tub and configured to rotate and control the agitation of the wash basket to cleanse the wash load loaded into the wash basket. Upon completion of a wash cycle, a pump assembly can be used to rinse and drain the soiled water to a draining system.

It has become increasingly desirable to reduce water consumption in washing operations. As such, there has been a growing trend towards reducing the water levels in top load washing machines. In these circumstances, clothes or other items located towards the top of a wash load in a top load washing machine may have difficulty turning over due to the lack of mechanical action and the reduced water level. The items that are situated above the reduced water level have a difficult time getting cleansed and have a difficult time having soap that is poured on top of the wash load rinsed away.

Thus, a need exists for a top load washing machine that provides for the more efficient cleaning of clothes located above a reduced water level in top load washing machines. An apparatus that rapidly dumps a large amount of water on the wash load, thereby driving water through the wash load at an increased rate, would be particularly useful.

BRIEF DESCRIPTION OF THE INVENTION

Aspects and advantages of the invention will be set forth in part in the following description, or may be obvious from the description, or may be learned through practice of the invention.

One exemplary embodiment of the present disclosure is directed to a washing machine. The washing machine includes a cabinet and a tub positioned within the cabinet. The washing machine further includes a basket rotatably supported with the tub. The basket can receive a wash load therein. The washing machine further includes a reservoir in fluid communication with the basket. The reservoir has the capacity to store a volume of wash liquid. The reservoir releases the volume of wash liquid into the basket when the volume of wash liquid in the reservoir has reached a threshold level.

Another exemplary embodiment is directed to a method for operating a washing machine. The washing machine includes a tub and a basket rotatably mounted with the tub. The method includes providing wash liquid to a reservoir in fluid communication with the basket. The reservoir has the capacity to store a volume of wash liquid. The method further includes releasing the volume of wash liquid from the reservoir basket when the volume of wash liquid in the reservoir reaches a threshold level.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
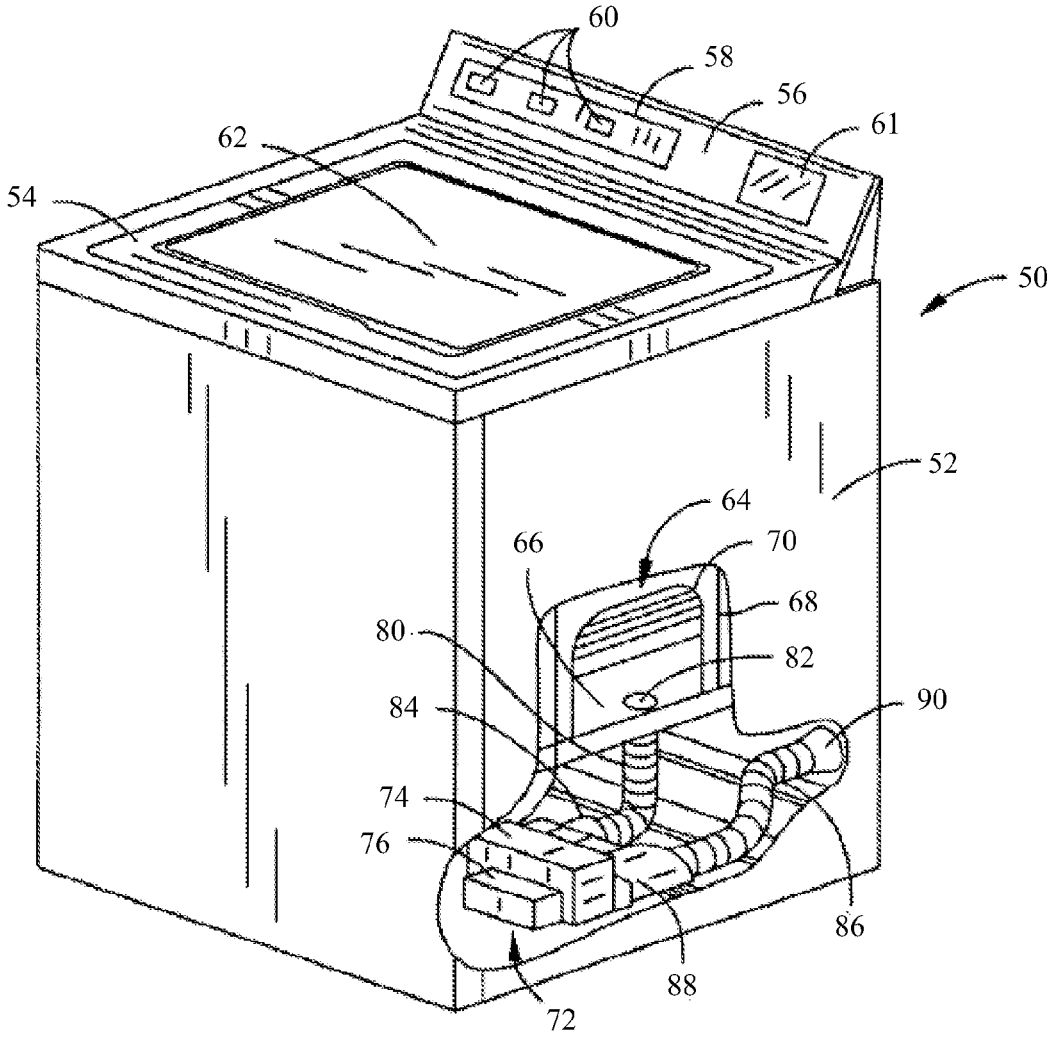
FIG. 1 is a perspective cutaway view of an exemplary top load washing machine according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present disclosure is directed to a top load washing machine that includes a reservoir for rapidly releasing a volume of wash liquid onto the top of a wash load. When a predetermined level of wash liquid is reached in the reservoir, the contents of the reservoir are released onto the top of the wash load. The rate of wash liquid delivered from the reservoir will typically be greater than the capacity of a pump used to deliver wash fluid to the basket, allowing the wash liquid from the reservoir to pass through the wash load at an increased rate. The surge of wash liquid onto the top of the wash load will allow for the more efficient cleaning and rinsing of the wash load and provide assurances for a user that clothes and other items located at the top of the wash load are receiving a sufficient amount of wash liquid.

FIG. 1 is a perspective view partially broken away of an exemplary top load (vertical axis) washing machine 50 including a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and other items of interest to machine users. A lid 62 is mounted to cover 54 and is rotatable about a hinge (not shown) between an open position (not shown) facilitating access to wash tube 64 located within cabinet 52, and a closed position (shown in FIG. 1) forming a sealed enclosure over wash tub 64.

Tub 64 includes a bottom wall 66 and a sidewall 68, and a basket 70 is rotatably mounted within wash tub 64. The top portion of tub 64 generally defines a tub opening (not shown). A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine drain outlet 90 and ultimately to a building plumbing system discharge line (not shown) in flow communication with drain outlet 90.

Figure 2:
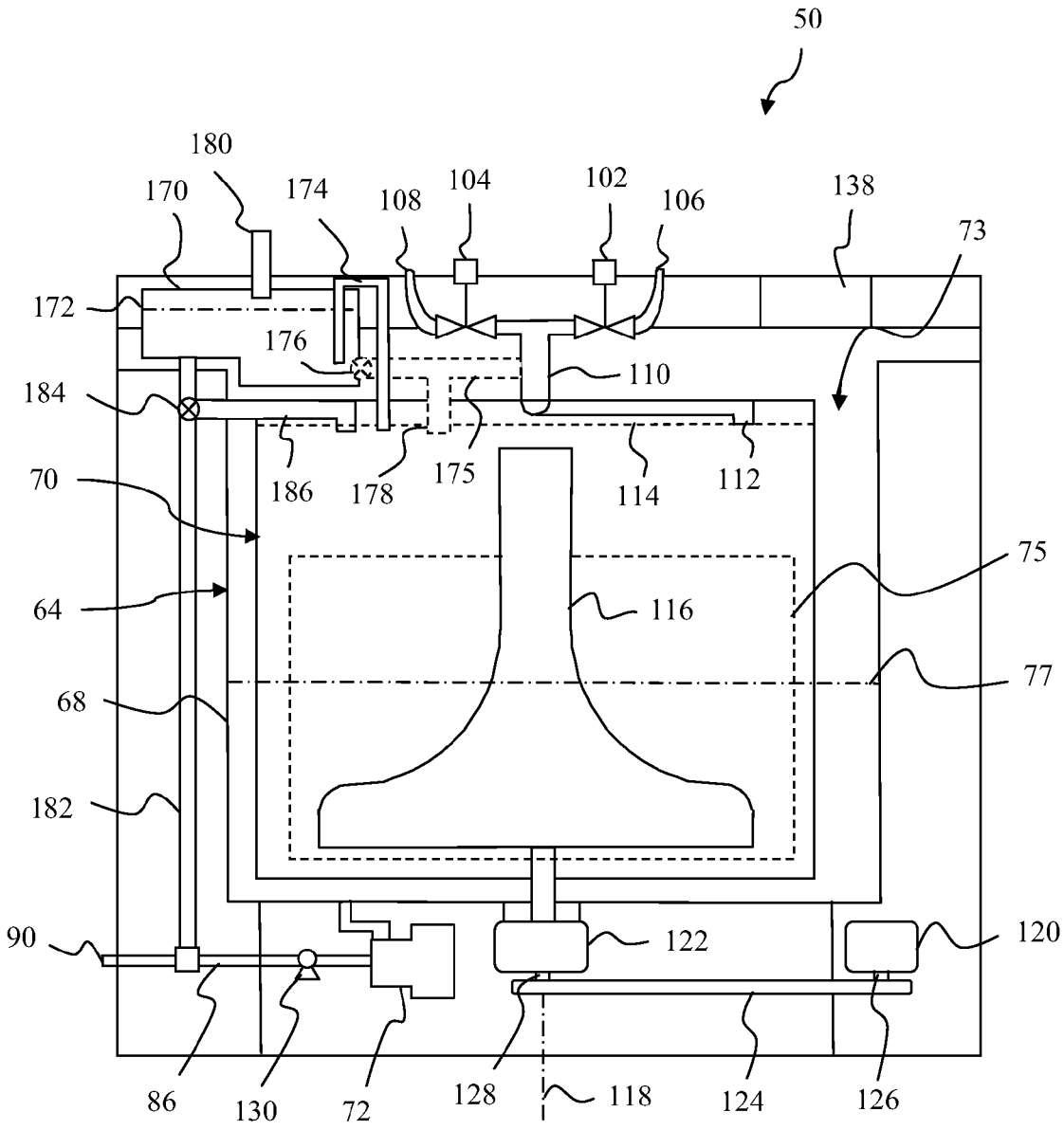
FIG. 2 is a front schematic view of the washing machine shown in FIG. 1.

FIG. 2 is a front elevational schematic view of washing machine 50 including wash basket 70 movably disposed and rotatably mounted in wash tub 64 in a spaced apart relationship from tub side wall 68 and tub bottom. A wash load 75 is disposed within basket 70. The top portion of tub 64 generally defines a tub opening 73. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 50 and, when connected to a building plumbing system (not shown), provide a fresh water supply for use in washing machine 50. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing of articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket 70. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitation element 116, such as a vane agitator, impeller, auger, or oscillatory basket mechanism, or some combination thereof is disposed in basket 70 to impart an oscillatory motion to articles and liquid in basket 70. In different embodiments, agitation element 116 may be a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 116 is oriented to rotate about a vertical axis 118.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120, the transmission and clutch system 122 and belt 124 collectively are referred herein as a machine drive system.

Washing machine 50 also includes a brake assembly (not shown) selectively applied or released for respectively maintaining basket 70 in a stationary position within tub 64 or for allowing basket 70 to spin within tub 64. Pump assembly 72 is selectively activated, in the example embodiment, to remove liquid from basket 70 and tub 64 through drain outlet 90 and a drain valve 130 during appropriate points in washing cycles as machine 50 is used.

Operation of machine 50 is controlled by a controller 138 which is operatively coupled to the user interface input located on washing machine backsplash 56 (shown in FIG. 1) for user manipulation to select washing machine cycles and features. In response to user manipulation of the user interface input, controller 138 operates the various components of machine 50 to execute selected machine cycles and features.

In an illustrative embodiment, laundry items are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of laundry items in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism.

After the agitation phase of the wash cycle is completed, tub 64 is drained with pump assembly 72. Laundry items are then rinsed and portions of the cycle repeated, including the agitation phase, depending on the particulars of the wash cycle selected by a user.

As illustrated in FIG. 2, the water level 77, for conservation and/or efficiency purposes, can be located below the top of wash load 75. This can presents difficulties in ensuring that the clothes and other items located at the top of wash load 75 are adequately cleansed and rinsed. To address this issue, the washing machine 50 further includes a reservoir 170 disposed above the tub 64. The reservoir 170 is configured to hold a volume of wash fluid, such as water or water/soap mix. When the volume of wash fluid in reservoir 170 reaches a threshold level, such as threshold level 172, the volume of wash fluid is released into the basket 70, causing a surge of wash fluid onto the top of wash load 75.

The surge of wash fluid onto the top of wash load ensures the clothes and other items in the top of wash load 75 and above the water level 77 are adequately cleansed and rinsed. In addition, the surge of wash fluid can also have a flow rate that is greater than a flow rate provided a pump used to provide water into the tub 64. In this manner, the surge of wash fluid provided by the release of wash fluid from reservoir 170 allows the wash liquid to pass through the wash load at an increased rate.

The wash liquid can be released from the reservoir 170 into the basket 70 in a variety of ways. For instance, as illustrated in FIG. 2, the wash liquid can be released through a siphon 174 or other mechanical device when the wash liquid in reservoir 170 reaches a threshold level. In another embodiment, the wash liquid can be released through a valve 176 (shown in phantom in FIG. 2) when the wash liquid in reservoir 170 reaches a threshold level. The valve 176 can be a mechanical valve configured to open to allow wash fluid to flow from the reservoir 170 when the wash fluid has built up in the reservoir to a threshold level, such as threshold level 172. As illustrated, the wash fluid can flow from reservoir 170 through valve 176 into the basket 70 through an independent opening 178 or can be provided through tubing 175 to basket inlet tube 110 so that the wash fluid can be released into tub 64 through nozzle assembly 112 or spray fill conduit 114.

In another embodiment, the valve 176 can be a control valve that is controlled by controller 138 to open and allow the release of wash fluid from reservoir 170 when the volume of wash fluid in reservoir 170 reaches a threshold level. In particular, controller 138 can monitor the volume of wash fluid in reservoir 170 through a sensor or other suitable monitoring device. When the volume of wash fluid in reservoir 170 reaches a threshold level, the controller 138 can open valve 176 to allow the volume of fluid in reservoir 170 to be released into basket 70.

Wash fluid can be provided to reservoir 170 from a variety of wash fluid supply sources. As shown in FIG. 2, wash fluid (e.g. water or water/soap mix) can be provided to reservoir 170 through inlet 180 from an external wash fluid source. In another embodiment, wash fluid can be provided to reservoir 170 through recirculation line 182. Recirculation line 182 receives wash fluid from tub 64 through pump assembly 72, drain valve 130, and pump outlet hose 86. Recirculation line 182 can include a diverter valve 184. Diverter valve 184 can be used to divert wash fluid from recirculation line 182 to reservoir 170 or to tub 64 through recirculation nozzle assembly 186. In a particular embodiment, controller 138 controls diverter valve 184 to selectively direct wash fluid from recirculation line 182 to reservoir 170 or tub 64.

Figure 3:
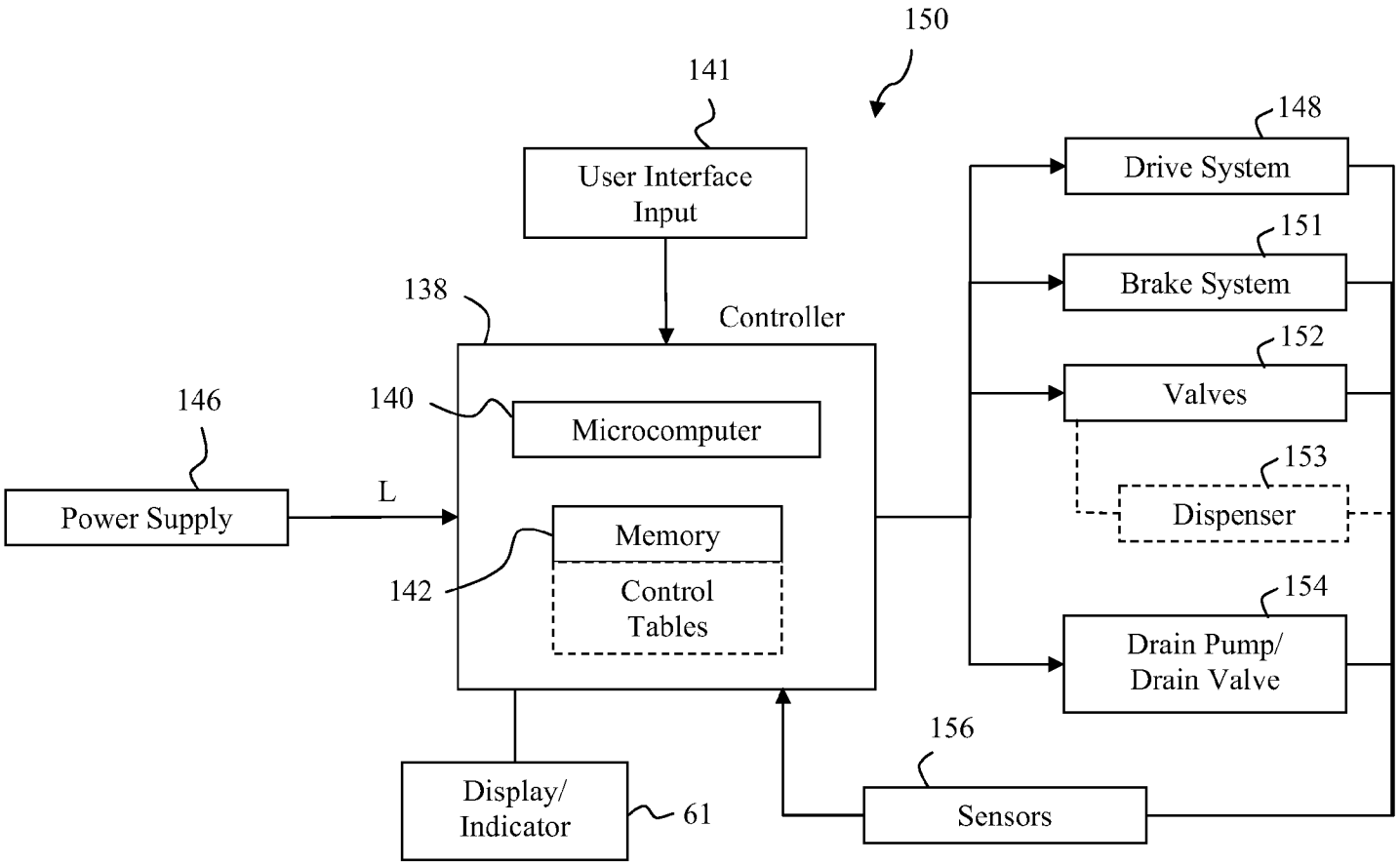
FIG. 3 is a schematic block diagram of a control system for the washing machine shown in FIG. 1 and FIG. 2.

FIG. 3 is a schematic block diagram of an exemplary washing machine control system 150 for use with washing machine 50 (shown in FIG. 1 and FIG. 2). Control system 150 includes controller 138 which may, for example, be a microcomputer 140 coupled to a user interface input 141. An operator may enter instructions or select desired washing machine cycles and features via user interface input 141, such as through input selectors 60 (shown in FIG. 1) and a display or indicator 61 coupled to microcomputer 140 displays appropriate messages and/or indicators, such as a timer, and other known items of interest to washing machine users. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to flash memory (FLASH), programmable read only memory (PROM), and electronically erasable programmable read only memory (EEPROM).

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to machine drive system 148 (e.g., motor 120, inverter drive 121, clutch system 122, and agitation element 116 shown in FIG. 2), a brake assembly 151 associated with basket 70 (shown in FIG. 2), machine water valves 152 (e.g., valves 102, 104, valve 176 and diverter valve 184 shown in FIG. 2) and machine drain system 154 (e.g., drain pump assembly 72 and/or drain valve 130 shown in FIG. 2) according to known methods. In a further embodiment, certain water valves 152 are in flow communication with a dispenser 153 (shown in phantom in FIG. 3) so that water may be mixed with detergent or other composition of benefit to washing of garments in wash basket 70.

In response to manipulation of user interface input 141 controller 138 monitors various operational factors of washing machine 50 with one or more sensors or transducers 156, and controller 138 executes operator selected functions and features according to known methods. For instance, in a particular embodiment, controller 138 can receive input from a sensor in reservoir 170 (shown in FIG. 2). When the volume of wash fluid in reservoir 170 reaches a threshold level, controller 138 can cause the release (e.g. through valve 176 of FIG. 2) of the volume of wash fluid in reservoir 170 into tub 64.

Of course, controller 138 may be used to control washing machine system elements and to execute functions beyond those specifically described herein. Controller 138 operates the various components of washing machine 50 in a designated wash cycle familiar to those in the art of washing machines. In one embodiment, controller 138 is configured to control motor 120 based on a drag torque sensed on basket 70. Controller 138 is configured to drive motor 120 in a torque-based, rather than a speed-based, mode.

Figure 4:
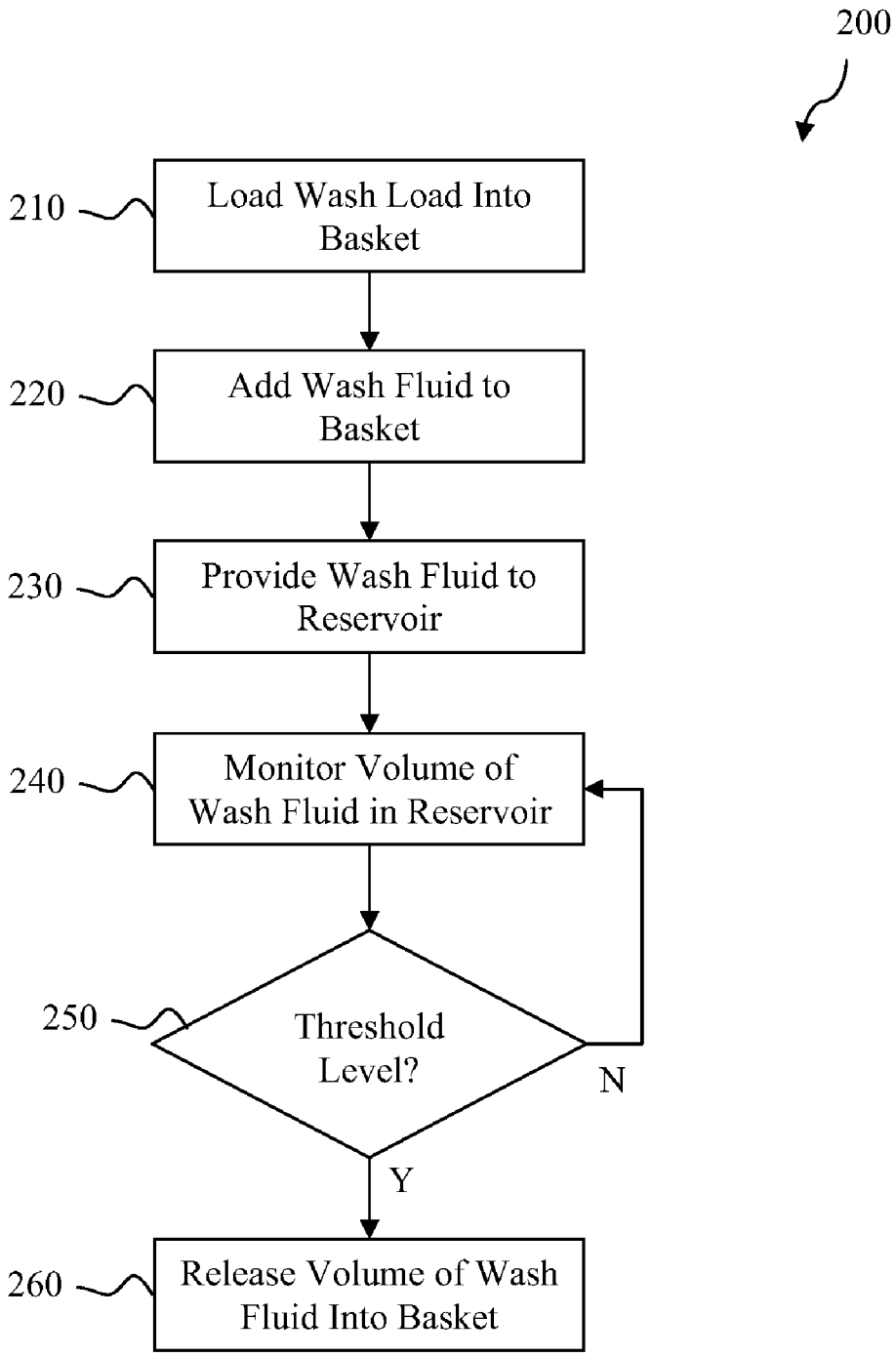
FIG. 4 is flow diagram of exemplary process steps for a method according to an exemplary embodiment of the present disclosure.

FIG. 4 is a flow diagram of exemplary process steps for a method 200 according to an exemplary embodiment of the present disclosure. At 210, a wash load is loaded into the basket of a top load washing machine. The basket can be rotatably supported in a tub. At 220, a wash fluid is added to the basket and to the tub. The wash fluid can be provided through hot and cold water valves from an external source.

At 230, a wash fluid is provided to a reservoir, such as a reservoir located above the tub of the washing machine. The reservoir is capable of storing a volume of wash fluid. The wash fluid can be provided to the reservoir from a wash liquid source external to the washing machine. Alternatively, the wash fluid can be provided to the reservoir from a recirculation line. For instance, the method 200 can include controlling a diverter valve located in the recirculation line to selectively divert wash fluid to the reservoir or to the tub.

At 240, the method 200 includes monitoring the volume of wash fluid in the reservoir. At 250, the method 200 determines whether the volume of wash fluid has reached a threshold level. If the threshold level has not been reached, the method 200 continues to monitor the volume of wash fluid in the reservoir until the threshold level is reached.

Once the threshold level is reached, the method 200 releases the volume of wash fluid from the reservoir into the basket as indicated at 260. The wash fluid can be released from the reservoir into the tub through a siphon, spray outlet, or a mechanical valve. Alternatively, the wash fluid can be released through a control valve or other similar device. The release of the volume of wash fluid causes a surge of wash fluid to be provided to the top of the wash load in the basket. The surge of wash fluid can occur at a flow rate greater than a flow rate used to provide water to the tub. In this manner, the method 200 provides for the efficient cleaning and rinsing of clothes and other items located at the top of a wash load, even in top load washing machines having reduced water levels.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine, comprising:

a cabinet;

a tub positioned within the cabinet;

a basket rotatably supported within said tub; and a reservoir in fluid communication with said basket, said reservoir having the capacity to store a volume of wash fluid;

a sensor configured to monitor the volume of wash fluid in said reservoir; and a controller;

wherein said controller is configured to control the release of wash fluid from said reservoir into said basket when the volume of wash fluid in said reservoir reaches a threshold level such that the flow rate at which the volume of wash fluid is released from said reservoir into said basket is greater than a flow rate provided by a wash fluid source separate from the reservoir used to provide wash fluid into said basket.

2. The washing machine of claim 1, wherein the volume of wash fluid is released from said reservoir to said basket through a siphon, a spray outlet, or a mechanical valve.

3. The washing machine of claim 1, wherein, the controller is configured to control a control valve to release the volume of wash fluid from the reservoir into said basket when the volume of wash fluid in said reservoir reaches a threshold level.

4. The washing machine of claim 1, wherein said basket receives a wash load, said reservoir releasing the volume of wash fluid onto the top of said wash load when the volume of wash fluid in said reservoir reaches the threshold level.

5. The washing machine of claim 1, wherein said reservoir is disposed above said tub.

6. The washing machine of claim 1, wherein said reservoir is in fluid communication with an outside wash fluid source.

7. The washing machine of claim 1, wherein said reservoir is in fluid communication with a recirculation line and a pump, said pump providing wash fluid from said tub to said recirculation line.

8. The washing machine of claim 7, wherein said recirculation line further comprises a diverter valve, said diverter valve operable to direct wash fluid from said recirculation line to said reservoir or to direct wash fluid from said recirculation line to said tub.

* * * * *